United States Patent [19]

Fabricius

[11] Patent Number: 5,069,017

[45] Date of Patent: Dec. 3, 1991

[54] ASEPTIC FILLING MACHINE FOR FOOD

[76] Inventor: Karl Fabricius, Weidstrasse 1, CH-6331 Hünenberg, Fed. Rep. of Germany

[21] Appl. No.: 550,968

[22] Filed: Jul. 11, 1990

[30] Foreign Application Priority Data

Jul. 15, 1989 [DE] Fed. Rep. of Germany ..... 3923539

[51] Int. Cl.[5] ..... B65B 47/00; B65B 55/08

[52] U.S. Cl. ..... 53/426; 53/453; 53/167; 53/559; 422/24

[58] Field of Search ..... 53/110, 141, 167, 426, 53/559, 425, 453; 422/24, 22, 186.3

[56] References Cited

U.S. PATENT DOCUMENTS

| | | | |
|---|---|---|---|
| 3,466,850 | 9/1969 | Hudson et al. | 53/426 |
| 3,884,012 | 5/1975 | Ernstsson et al. | 53/426 |
| 3,911,640 | 10/1975 | Rausing | 53/426 |
| 4,035,981 | 7/1977 | Braun et al. | 53/426 |
| 4,494,357 | 1/1985 | DiGeronimo | 53/426 X |
| 4,512,133 | 4/1985 | Torterotot | 53/426 X |
| 4,543,770 | 10/1985 | Walter et al. | 53/426 X |
| 4,597,242 | 7/1986 | Hendriks et al. | 53/426 |
| 4,656,813 | 4/1987 | Baldini et al. | 53/426 X |

FOREIGN PATENT DOCUMENTS

| | | | |
|---|---|---|---|
| 0158805 | 10/1985 | European Pat. Off. | 53/426 |
| 0025189 | 3/1978 | Japan | 53/426 |
| 0595248 | 2/1978 | Switzerland | 53/426 |
| 1440799 | 11/1988 | U.S.S.R. | 53/426 |

*Primary Examiner*—John Sipos
*Assistant Examiner*—Linda B. Johnson
*Attorney, Agent, or Firm*—Brown, Martin, Haller & McClain

[57] ABSTRACT

An aseptic filling machine for food is described which is filled in containers of a deep-drawn bottom film and sealed with a top film. In order to get a properly aseptic packaging, the bottom and top film are cleaned wet or dry, deionized and sterilized in a clean-air chamber in which the food is filled, and sterilized by means of UV-C radiators.

11 Claims, 1 Drawing Sheet

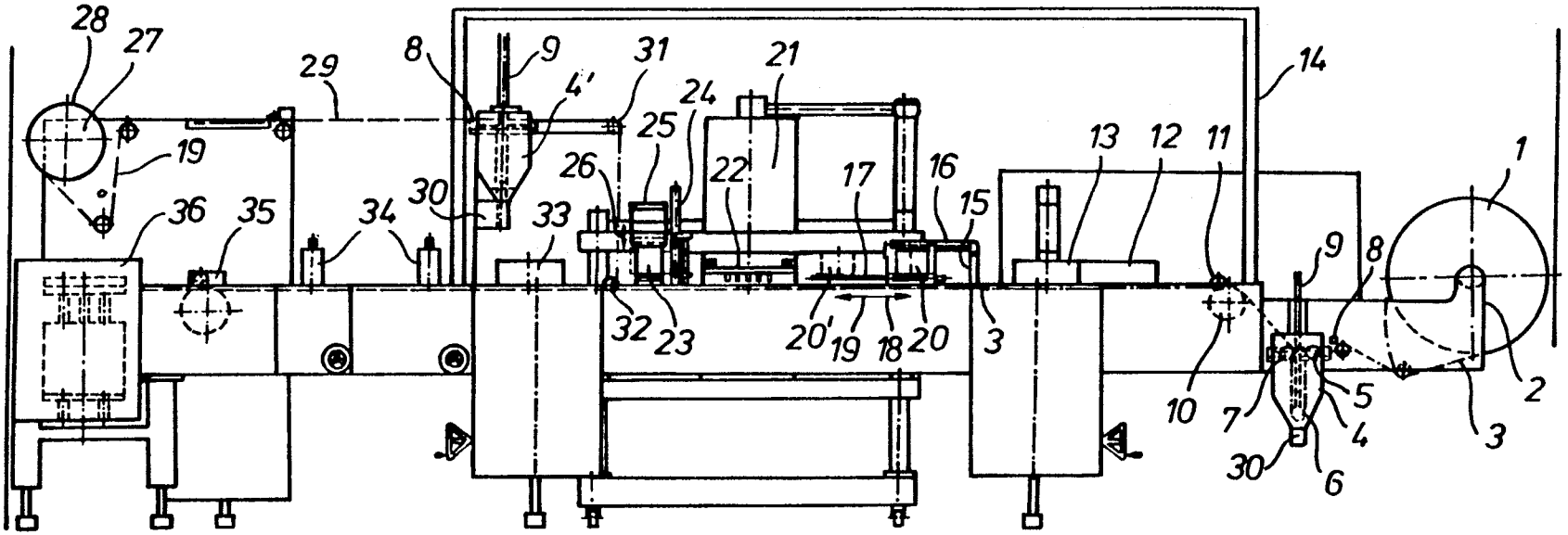
1
2
3
4
5
6
7
8
9
10
11
12
13
14
15
16
17
18
19
20
20'
21
22
23
24
25
26
27
28
29
30
31
32
33
34
35
36
4'

ASEPTIC FILLING MACHINE FOR FOOD

BACKGROUND OF THE INVENTION

The invention relates to an aseptic filling machine for food, in which food is filled in containers of a deep-drawn bottom film and the container is sealed against a top film. The machine has storage rolls for the top and bottom film, with sterilizing devices for the films and a clean-air-area installed behind the sterilizing devices in which the food is filled in the containers formed from the bottom film which are closed and packaged hermetically and sterile with the top film.

With this kind of machinery, liquid and pastry products, especially for the food industry, are packed aseptically and sterile. The invention is particularly directed to the sterile packaging of foods such as coffee cream, pudding yoghurt and all kinds of fruit juices and similar products.

All known machines have basically the same construction. At first the film is drawn from a roll and inserted into the machine as bottom film. Before the film is inserted into the machine, it is cleaned and deionized and after the deionization it is inserted into a forming station where cup-shaped containers of this film are formed.

The film thus formed into cup-shaped containers is moved into a stetrile area where the food is filled into the containers under sterile conditions.

Furthermore, it is known to use a top film to close the filled containers. The top film is also cleaned and deionized and afterwards sealed against the containers filled with food.

With the machines known up to now there were problems with the sterilization of the top and bottom film as well as with the maintaining of sterile conditions in the clean area in which the product is filled.

In one known machine, the sterilization of top and bottom film is done chemically, for instance by leading the film through a solution of hydrogenperoxide. However, the disadvantage of this method of cleaning is the handling of this relatively dangerous and irritating chemical.

Furthermore, it is known to sterilize the top and bottom film by means of steam. The disadvantage of this known steam sterilization technique is that a discharge for the condensate has to be provided. Therefore a special film of high form-stability has to be used and this is a highly energy-consuming design because the sterilization has to be done at 140° C.

Furthermore steam pressure containers have to be used for this purpose which have to be authorized for safety purposes by special authorities this results in high machine costs for this kind of steam sterilization.

Furthermore, it is known to use top and bottom films which are already aseptic, but this results in high film costs; this type of aseptic film has a protecting layer which has to be torn away and removed during the processing which results in increased refuse disposal.

SUMMARY OF THE INVENTION

It is therefore an object of the present invention to provide an improved sterile packaging machine with which all deep-drawable flims can be used, with considerably less production costs.

According to the present invention, an aseptic filling machine for filling containers with materials such as foodstuffs is provided, in which storage rolls supply top and bottom films and cleaning stations are provided for both films after the storage rolls in which the films are freed of foreign substances. The cleaned films are deionized after the cleaning stations, and are sterilized in a clean air chamber by means of UV-C radiators.

The top film as well as the bottom film are cleaned after being torn off the roll. Both film sheets are deionized before and after being cleaned and the films thus prepared are inserted in the clean-air chamber in which the filling station and the sealing station are located, whereby the sterilization of top and bottom film is done by means of UV-C radiators in the area of this clean-air chamber.

Attention is drawn to the fact that the above mentioned cleaning of the film consists only of a wet or dry cleaning with which only dust particles and other foreign substances should be removed from the surface of the film.

The films may be cleaned either by means of a wet cleaning or a dry cleaning procedure.

For the wet cleaning the film runs through a bath which is filled with heated water to which a cleaning chemical may optionally be added. The water can also be pure tap water. In the tub of this cleaning bath ultrasonic devices are arranged which put the water in oscillation so that it is guaranteed that the film running through the water bath is freed of foreign substances.

Wiper blades are provided adjacent the exit of each water bath which wipe of any liquid adhering to the film as it runs out of the bath.

The protection of the present invention should also include the dry cleaning of the top and bottom film. In the alternative dry cleaning technique, the film runs through a chamber with slot nozzles which repeatedly suck the film in and release it again and thus bring it into oscillation. These oscillations result in the throwing off of foreign substances adhering to the film and in sucking them away by means of a suction device.

This dry cleaning device is already known in connection with other machines, i.e. with printing machines, but it is completely new to use such a dry cleaning device in connection with the cleaning of top and bottom film as in the present invention.

With all described cleaning procedures it is necessary to deionize the film either before or afterwards.

With the dry cleaning procedure it is preferred to deionize the film before it is inserted in the cleaning chamber, whereas with the wet cleaning procedure it is preferred to deionize the film after running through the wet cleaning bath.

The described operations may be used for the top film as well as for the bottom film.

After running through the deionizing station, the now prepared bottom film is inserted into a heating station, where the plastic of the film is heated close to its deformation point. Subsequently, the film is inserted into a forming station where the containers are formed in forming dies under sterile air pressure.

After the forming of the containers this film with the formed containers is moved into the clean-air chamber.

A series of UV-C radiators are arranged in the clean air chamber to irradiate the whole film width. These UV-C radiators can be arranged to swing back and forth so that they cover the whole film sheet in the area of the film advance per cycle.

The radiators may run parallel to the longitudinal direction of travel of the film. The radiators are moved with the film in a first direction during a film advance cycle as the film is continuously irradiated, and are then retracted back to a starting position ready for the next film advance cycle.

After transporting the radiators for a certain length, they are stopped and removed in the opposite direction, i.e. opposite to the transport direction of the film. Thus the same area is again irradiated so that a double radiation dose is applied on each area. Thus a reliable sterilization of the film is made with a minimum of heating of the film which consequently remains stable.

A further advantage of having the UV-C radiators running parallel is that the rows of the irradiated containers in front of and behind in transport direction still lie reliably in the UV-C radiation cone, which is not always guaranteed with a stationary source of radiation.

Since the radiating capacity is reduced by the square of the distance from the radiator, the first and last rows in transport direction would not be irradiated sufficiently with a stationary UV-C source of radiation. This is avoided with a parallel running source of radiation.

Due to the fact that the top film is flat and even and does not have such formed containers, it is not necessary to use a parallel running source of radiation for the sterilization of the top film by UV-C radiators. Here the source of radiation can be arranged at a fixed place. However, it is important that the total sterilization takes place in the clean-air area itself.

Furthermore it is important that there is overpressure in the clean-air area, i.e. the air of the environment is lead through two or more filter systems, whereby a rough filter, a fine filter and eventually an absolute filter are connected one after the other, so that there is an elimination in the micron-area and thus spurs, bacteria, and fine dust are eliminated. Tests have shown that with such an arrangement of clean-air mildew and bacteria are reliably destroyed.

It is important that the clean air is lead into the clean-air area under overpressure and escapes by overpressure to the environment so that in the clean-air area itself there is always clean air only.

The insertion of film sheets and the discharge of the film sheets also takes place under the stream of the clean air so that even through these areas no foreign substances or toxic materials can be brought into the clean-air area.

Furthemore it is important that in the clean-air area the filling of the food is done under absolutely sterile conditions. This food is inserted into the containers at the filling station by a sterile dosing pump by insert devices such as hoses.

The sterilization of the product is done in an ultrahigh-treating appliance.

After the food is filled into the containers, the filled containers run into the sealing station which is also located in the clean-air area.

A double effect is reached by directing the source of radiation for sterilizing the top film in a way that it irradiates the head space of the sealing station and thus also provides the sterility of the head space of this station. Thus the small quantity of air which is sealed in the packing along with the food is reliably sterilized so that the sterile conditions are absolutely preserved.

After hotsealing the package with the top film, the finished package leaves the machine, i.e. the clean-air area and runs through several cutting stations and cutting knives in order to be cut according to the packaging sizes.

BRIEF DESCRIPTION OF THE DRAWING

The drawing illustrates a side view of an aseptic filling machine according to a preferred embodiment of the present invention.

DESCRIPTION OF THE PREFERRED EMBODIMENT

The aseptic filling machine illustrated in the drawing basically comprises first and second film supply rolls 27 and 1 which supply top and bottom film 29, 3 along first and second travel paths into a clean air chamber 14 in which the bottom film is formed into containers, the containers are filled with food, and the containers are sealed with the top film.

The films pass through first and second cleaning stations 4', 4, first and second deionization stations, and irradiation stations 23, 20. Preferably, each deionization station includes a deionization device 8, 11 both before and after the respective cleaning station 4',4.

The operations carried out on the bottom film as it travels on its path through the machine will now be described in more detail. The bottom film 3 is unrolled by pulling it of a roll 1 which rests on an unrolling device 2.

After running through some guide pulleys with a deionization device 8, the bottom film 3 is inserted into a cleaning bath 4 which works as a liquid cleaning of the film.

The film runs through three guide pulleys 5,6,7 arranged in sequence in the bath as illustrated in the drawing, with the center pulley 6 fixed at the free bottom end of a lifting rod 9.

In the cleaning bath 4 is water which is put into oscillation by an ultra-sonic arrangement and is heated over a heating system 30. Thus the foreign substances on the film are removed and the film leaves the cleaning bath at the pulley 7 where wipers, not presented in detail, are located which wipe away the excess liquid from the film.

After leaving the cleaning bath 4 the film comes into the clean-air area 14. The clean air area or chamber 14 contains only filtered air, free of dust and foreign substances.

The air is kept under overpressure so that there is always clean and sterile air in the clean-air area 14.

A UV-C radiator arrangement is provided in the insert area of the bottom film into the clean air chamber 14. Also provided at the insert area are an insert roll 10, a deionization device 11, a preheating station 12 and a forming station 13. In the forming station the film is heated up to a temperature at which it is capable of being plastically formed. In the forming station 13 containers are formed in a forming die by sterile air pressure.

After running through the forming station 13, i.e. after forming of the containers, the bottom film 3 comes into the area of the UV-C radiator 20.

The radiator is mounted to be moveable in the direction of the arrows 18, 19, i.e. parallel to the transport direction of the bottom film.

The radiator 20 is suspended from a carriage comprising transport cylinder 16 extending from fixture 15. The radiator is guided laterally by guide bars 17.

The film 3 is moved through the whole system in a series of film advance cycles.

With the beginning of a cycle the radiator 20 is at first in its backward position, as presented in the drawing.

During each film advance cycle, the film is advanced a predetermined amount in the direction of arrow 19. Simultaneously, the radiator 20 is driven in synchronization with the film by the drive cylinder 16 until it reaches its advanced position 20' illustrated in dotted outline in the drawing.

The film then stops and the radiator moves away from its position 20' above the now stationary film, back to the starting position.

Thus each section of film is irradiated twice to ensure that the film is sterilized reliably over its entire area.

After this the film comes into the area of the filling station 21 which feeds a dosing plate 22.

The dosing plate 22 fills the containers of the bottom film 3 uniformly under sterile conditions.

After this the filled bottom film 3 comes into the area of a sealing station 33.

As the bottom film is being treated as described above, the top film is also being pulled through the various treatment stations illustrated in left hand side of the drawing before being inserted into the clean air chamber.

The top film 29 is pulled from a roll 28 which is also arranged in an unrolling device 27.

Over several pulleys the top film 29 comes into the area of the cleaning bath 4' which, together with the deionization arrangements 8 and 10, is built exactly like the cleaning bath 4 as described before to clean the bottom film.

After this the top film 29 is guided over two pulleys 31, 32 parallel to the bottom film 3 and inserted into the sealing station 33 close to the filled bottom film.

It is now important that in the vertical area of the top film a further, unmoveable radiator 23 is fixed. This radiator irradiates the vertical parts of the top film and irradiates through below the pulley 32 into the sealing station 33.

The radiation which is directed from radiator 23 sterilizes the air in this headspace so that the remaining air in the package is also sterilized reliably.

Thus, the sealing station is kept sterile too. In addition gas flushing of the head-space with a protective gas is also possible.

To protect the operating personnel while the machine is stationary between film advance cycles, so that they will not look into the operating radiator 23, a protective device 25 is provided which is arranged in vertical direction (arrow direction 26) at a cylinder 24.

When the machine stands still and is open, the protective device 25 moves down and covers the radiator 23.

After leaving the sealing station 33 the ready packed and sealed package moves out of the clean-air area 14 and comes into the area of two devices for cross perforation 34 and subsequently in the area of a device for longitudinal perforation 34 where rupture lines are put in to separate the packages.

Then the package comes into a complete cutting station 36 where the cutting of the package is finished. After this it is lead into a further packaging machine.

For the present machine it is important that a completely sterile packaging line is built with relatively few expenses, which is free of chemicals, non-polluting and which guarantees the use of all deep-drawable films, so that no special films are required.

It is important that the described UV-C radiator arrangement with the radiator 20 which is moved back and forth in parallel with the transport direction of bottom film 3, is only used to sterilize relatively shallow containers up to a depth of approx. 30 mm. This depends also on the diameter of the containers.

For deeper packages, red-shaped UV-C radiators are provided which can be moved in vertical direction, i.e. several rod-shaped radiators are provided whereby each radiator is meant for one cup and the radiator moves shortly into the container and out again so that thus the interior of the cup is sterilized.

These radiators do not move horizontally but are fixed horizontally and can only be lowered and lifted vertically. If 20 cups are to be sterilized, there also has to be the same number of radiators.

I claim:

1. An aseptic filling machine for filling and sealing containers with food under aseptic conditions, comprising:

a clean air chamber;

a top film supply roll;

first transport means for transporting a top film from the supply roll along a first path through the clean air chamber;

a bottom film supply roll;

second transport means for transporting a bottom film from the bottom film supply roll along a second path through the clean air chamber;

first and second deionization means located in said first and second paths, respectively, for deionizing said films;

first and second cleaning stations located in said first and second paths, respectively, for cleaning said top and bottom films;

forming means in the second path for forming the second film into a series of containers having open tops;

filling means for filling said containers with material;

sealing means for sealing said top film against the open tops of said filled containers;

first and second UV-C radiators located in said clean air chamber for irradiating the top and bottom films, respectively; and third transport means for transporting said second UV-C radiator to advance parallel to and in synchronization with said bottom film along said second path for a predetermined distance and to retract the second UV-C radiator back to a start position so that a portion of the film is irradiated a first time as the UV-C radiator retracts and said portion is irradiated a second time as the film and the UV-C radiator advance together.

2. The machine as claimed in claim 1, wherein at least one of the cleaning stations comprises a wet bath of cleaning liquid and an ultrasonic vibrating device for oscillating the liquid in the bath.

3. The machine as claimed in claim 2, wherein both cleaning stations comprise wet baths.

4. The machine as claimed in claim 2, wherein the cleaning liquid comprises water.

5. The machine as claimed in claim 2, including wiper means at an exit end of said wet bath for wiping excess moisture adhering to the film as it leaves the bath.

6. The machine as claimed in claim 1, wherein at least one of the cleaning stations and both UV-C radiators are located in the clean air chamber.

7. The machine as claimed in claim 1, including means for supplying over-pressure of clean air into the clean air chamber.

8. The machine as claimed in claim 1, wherein said first UV-C radiator is directed to irradiate said top film and a headspace of said sealing station simultaneously.

9. The machine as claimed in claim 1, wherein each deionization means includes a first deionization device in each travel path before said cleaning station and second deionization device in each travel path after said cleaning station.

10. A method of packing goods under aseptic conditions, comprising the steps of:

moving top and bottom films from supply rolls along a predetermined path into a clean air chamber;

passing each film through a deionization station;

passing each film through a cleaning station for removing debris from the film;

forming the bottom film into a series of cup-shaped containers;

passing the bottom film through an irradiation station in which a radiator head moves in synchronization with the film from a start position along said predetermined path and then reverses direction to return to the start position so that a portion of the film is irradiated a first time as the radiator head reverses direction and said portion is irradiated a second time as the film and the radiator head move together;

filling the formed containers in the bottom film with material;

passing the filled containers to a sealing station;

transporting the top film to the sealing station above the filled containers;

irradiating the top film; and sealing the top film to the filled containers.

11. The method as claimed in claim 10, wherein the top film is irradiated at the sealing station and the headspace of the sealing station is irradiated simultaneously.

* * * * *